United States Patent [19]

Hamren

[11] Patent Number: 4,612,597

[45] Date of Patent: Sep. 16, 1986

[54] CIRCUIT FOR CONTROLLING AND INDICATING FUEL INJECTOR OPERATION

[75] Inventor: Glen C. Hamren, Greentown, Ind.

[73] Assignee: General Motors Corporation, Detroit, Mich.

[21] Appl. No.: 683,342

[22] Filed: Dec. 19, 1984

[51] Int. Cl.[4] ..... H01H 47/32; F02D 41/30

[52] U.S. Cl. ..... 361/152; 123/490

[58] Field of Search ..... 123/490; 361/152

[56] References Cited

U.S. PATENT DOCUMENTS 3,172,020 3/1965 Spinelli et al. .

3,946,285 3/1976 Beery et al. .

4,140,084 2/1979 Nunzio .

4,511,945 4/1985 Dielsen ..... 133/490 X

*Primary Examiner*—Michael L. Gellner

*Attorney, Agent, or Firm*—Howard N. Conkey

[57] ABSTRACT

A circuit for controlling and indicating the operation of an electromagnetic fuel injector is described in which the injector current is regulated to a predetermined value by switching the injector coil current on and off in response to the coil current value relative to the predetermined value. Operation of the injector is sensed by sensing the change in direction in the duty cycle of the switched coil current as the duty cycle varies while the injector armature moves toward and strikes its stop position.

2 Claims, 1 Drawing Figure

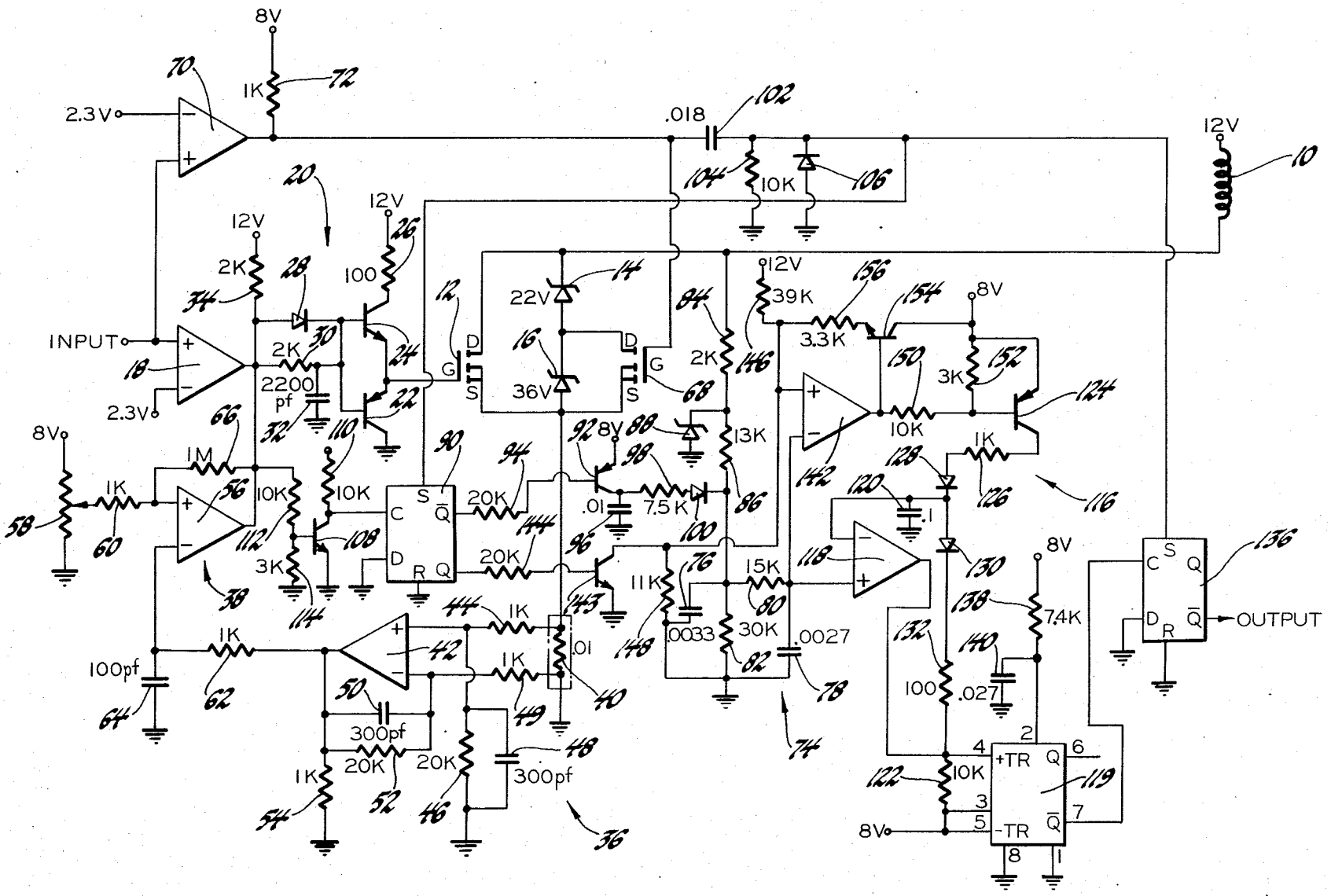
OUTPUT
INPUT
12V
8V
2.3V
.018
10K
39K
3.3K
3K
1K
7.4K
.027
100
.0027
15K
30K
13K
2K
7.5K
.0033
11K
.01
22V
36V
20K
300pf
2200 pf
100pf
+TR
-TR

CIRCUIT FOR CONTROLLING AND INDICATING FUEL INJECTOR OPERATION

This invention relates to a circuit for controlling and indicating the operation of an internal combustion engine electromagnetic fuel injector.

Electromagnetic fuel injectors typically are energized by the application of current through the coil of the injector of sufficient amplitude to cause the armature to move and initiate fuel injection. A delay time exists between the initial application of solenoid current and the time the armature moves from its deenergized position to its stop position at which fuel injection is considered initiated. Because this delay can become significant and vary from injector to injector in a multi-cylinder engine, fuel distribution to each cylinder of the engine, emissions, and engine timing can be adversely affected. It is desirable to measure the time at which the armature of each of the fuel injectors reaches its stop position at which fuel injection is initiated so that the fuel controller can compensate for the delay time to minimize the variation in fuel distribution to the cylinders, minimize emissions and to provide consistent engine timing from cylinder to cylinder.

One known system for sensing when the armature of a fuel injector has reached its stop position to initiate fuel injection employs linear current control of the injector solenoid current. When the armature reaches its stop position, an inflection in the current occurs. This inflection is sensed to provide an indication of the initiation of fuel injection. However, linear control of the injector solenoid current results in a large power loss in the series current limiting components.

In accord with the present invention, a circuit is provided for sensing the time at which the fuel injector armature reaches its stop position to initiate fuel injection in conjunction with a pulse width modulated current regulating system. The pulse width modulated current regulating system provides for a substantial improvement of the efficiency of the injector control system. By utilizing the injector operation sensor in conjunction with pulse width modulated control of the injector current, considerable savings and size reductions may be realized in the injector drive systems.

The invention may be best understood by reference to the following description of a preferred embodiment and the single figured drawing which is an electrical schematic of the circuit for controlling and indicating the operation of an electromagnetic fuel injector.

Referring to the drawing, a fuel injector coil 10 (which may be one of several in a multi-cylinder engine) is selectively energized to meter a specified amount of fuel to an internal combustion engine. The coil 10 is operative when energized to move a core from a deenergized position to a stop position to initiate fuel injection. In one embodiment, the core movement to its stop position may operate to open an orifice to meter fuel. In another embodiment, such as in a diesel fuel injector, the core may be operative when moved to its stop position to close off a spill port to initiate fuel injection.

One side of the coil 10 is coupled to the positive terminal of a voltage source such as the 12 volt vehicle battery and the other side is coupled to the drain of a field effect transistor 12. The source of the transistor 12 is coupled to ground. The on/off state of the transistor 12 is controlled so as to control energization of the coil 10. A current charging path is provided for the coil 10 when the transistor 12 is biased on to couple the coil 10 across the 12 volt supply. A current discharge path for the coil 10 is provided with the transistor 12 is placed in its off state by two series coupled Zener diodes 14 and 16 that are in parallel with the drain and source of the field effect transistor 12.

An injector command signal generated by an injection computer (not shown) controls the transistor 12 via a switch 18 and a field effect drive circuit 20. When the injection command signal goes high at the positive input of the switch 18, the drive circuit 20 responds to the resulting high voltage output of the switch 18 and applies a drive voltage to the gate of the field effect transistor 12 which is biased on to provide a current charge path for the coil 10. When the injection command signal then goes low, the drive circuit 20 responds to the resulting low input thereto from the switch 18 and grounds the gate of the field effect transistor 12 which is biased off. The coil then begins to discharge quickly through the discharge path provided by the Zener diodes 14 and 16.

The field effect transistor drive circuit 20 includes a PNP transistor 22 and an NPN transistor 24 series coupled with a resistor 26 between the positive terminal of the 12 volt source and ground. The gate of the field effect transistor 12 is coupled to the emitters of each of the transistors 22 and 24. The signal for controlling the conduction states of the transistors 22 and 24 is applied to their bases via a diode 28 and a filter comprised of a resistor 30 and capacitor 32. A pull-up resistor 34 is coupled between the 12 volt source and the output of the switch 18.

When the injector command signal is applied to the positive input of the switch 18, the transistor 24 is biased conductive (on) and the transistor 22 is biased nonconductive (off) to apply a drive signal to the gate of the field effect transistor 12 which is biased on. Conversely, when the injector command signal at the positive input of the switch 18 is terminated, its output goes low and biases the transistor 24 off and the transistor 22 on to ground the gate of the field effect transistor 12 which is biased off.

When the current through the coil 10 attains a predetermined level sufficient to cause the armature to move from its deenergized position to its stop position to initiate fuel injection, the current through the coil 10 is regulated for the remaining duration of the injector command signal by alternately switching the field effect transistor 12 on and off to maintain the average coil current at substantially the predetermined level. This is accomplished by a current sensing circuit 36 and a current limit switch 38 that controls the drive circuit 20 in response to the sensed current level in the coil 10.

The current sensing circuit 36 includes a current sensing resistor 40 series coupled with the coil 10 so that the voltage thereacross is a measure of the coil 10 current. The high voltage side of the current sensing resistor 40 is coupled to the positive input of an amplifier 42 via a filter comprised of resistors 44 and 46 and a capacitor 48. The low voltage side of the current sensing resistor 40 is applied to the negative input of the amplifier 42 via a resistor 49. The amplifier 42 includes a feedback circuit comprised of a capacitor 50 and resistors 52 and 54.

The current limit switch 38 includes a comparator switch 56 having a reference voltage applied to its positive input from a potentiometer 58 through a resistor 60. The potentiometer is coupled between the positive terminal of a regulated voltage source such as an 8 volt source and ground and provides a signal representing the voltage at the output of the current sensing circuit 36 when the current through the coil 10 as sensed by the current sensing resistor 40 attains the predetermined limit. The output of the current sensing circuit 36 is applied to the negative input of the comparator switch 56 through a filter comprised of a resistor 62 and a capacitor 64. A feedback resistor 66 of the comparator switch 56 provides for a hysteresis in its switch point. The output of the current limit switch 38 is applied to the input of the drive circuit 20.

While the injection command signal is applied to the switch 18 to bias the transistor 12 on via the drive circuit 20, the current limit switch 38 is effective to bias the transistor 12 off while the current through the coil 10 exceeds the limit value by grounding the input to the drive circuit 20. During the period of this injection command signal and when the transistor 12 is biased off by operation of the current sensing circuit 36 and the current limit switch 38, the coil 10 discharges thru the Zener diode 14 only. This is accomplished by a field effect transistor 68 parallel coupled with the Zener diode 16, a comparator switch 70 and its associated pull up resistor 72. The transistor 68 is biased on to short the Zener diode 16 by the high voltage output of the switch 70 during the period of an injection command pulse.

In operation, when the injector command signal is first applied to the switch 18, the field effect transistor 12 is biased on to initiate charging of the coil 10. As the current through the coil 10 increases, the voltage across the current sensing resistor 40 increases until the output of the current sensing circuit 36 equals the reference current established by the potentiometer 58 plus the hysteresis offset established by the resistor 66. At this current level, the output of the current limit switch 38 shifts to ground potential to bias the field effect transistor 12 off via the drive circuit 20. The coil 10 then discharges through the Zener diode 14 and the field effect transistor 68 and the current sensing resistor 40. When the current decreases to a level wherein the output of the current sensing circuit 36 is equal to the reference established by the potentiometer 58, the output of the current limit switch 38 again shifts to its high voltage level to bias the field effect transistor 12 on via the drive circuit 20. The current through the coil 10 again increases and the foregoing cycle is continually repeated to maintain the coil current substantially at the predetermined level established by the potentiometer 58.

When the injector command signal is first applied to the switch 18 and the field effect transistor 12 is biased on to begin charging the coil 10, the current builds up to the predetermined level at which the armature is moved from its deenergized position toward the stop position. This occurs at a time before the core reached its stop position. When the current attains the predetermined maximum level, current regulation is provided as above described by switching the transistor 12 between its on and off states.

During the period that the core is moving toward the stop, the current charging rate of the coil 10 is low and decreases due to the back EMF generated by the core accelerating in the coil 10 and to the changing inductance of the coil. This results in a duty cycle of the on-off states of the field effect transistor 12 having a high value as the transistor is controlled to regulate the current at the maximum value. In this respect, the duty cycle value is the percentage of a complete cycle of the on-off states of the transistor 12 represented by the on state of the transistor 12. When the armature strikes the stop position and the counter EMF associated with the movement of the core terminates, the charging rate of the coil 10 increases during the period that the field effect transistor 12 is biased on. This results in a sudden shift in the duty cycle of the on-off states of the field effect transistor 12 to a lower value. It is this characteristic of the duty cycle of the on-off states of the transistor 12 that is utilized to detect when the armature has reached its stop position and therefore the beginning of injection.

The duty cycle of the on and off states of the field effect transistor 12 is sensed generally by a filter 74 comprised of capacitors 76 and 78 and resistors 80 and 82. The drain of the field effect transistor 12 is coupled to the filter via resistors 84 and 86, the voltage at the junction of those resistors being limited by a Zener diode 88. As can be seen, when the field effect transistor is biased on, the input to the filter is substantially ground potential. Conversely, when the field effect transistor 12 is biased off, the input to the filter increases to a voltage establishec by the Zener diode 88. The voltage output of the filter 74 is a measure of the duty cycle of the on-off states of the field effect transistor 12.

The voltage output of the filter 74 is initialized to a high voltage level and thereafter enabled to assume a voltage that is a function of the duty cycle of the on-off states of the field effect transistor 12 when the output of the current limit switch 38 first goes low indicating that the current to the coil 10 has first attained the predetermined maximum level. This is accomplished by means of a D-flip flop 90 whose $\overline{Q}$ output is coupled to the base of a PNP transistor 92 via a resistor 94. When the transistor 92 is biased on, an 8 volt source is coupled to the filter 74 via a filter comprised of a capacitor 96 and a resistor 98 and through a diode 100 to charge the filter to an initialized voltage level. Thereafter, when the transistor 92 is biased off, the filter 74 is allowed to assume a voltage level as dictated by the duty cycle of the on-off states of the field effect transistor 12.

The flip flop 90 is initially set so that the $\overline{Q}$ output is at a low voltage level to cause the transistor 92 to charge the filter to the initialized level by means of a pulse generator including a capacitor 102, a resistor 104 and a diode 106 coupled to the output of the switch 70. When the output of the switch 70 first goes high in response to the injector command signal, a pulse is generated to set the flip flop 90 to provide for initialization of the filter 74. Thereafter, when the current through the coil 10 first attains the predetermined regulated level, the flip flop 90 is clocked by the output of the current limit switch 38 via a drive circuit including a transistor 108 and resistors 110, 112 and 114. The $\overline{Q}$ output of the flip flop 90 is shifted, when clocked, to a high level to bias the transistor 92 off to thereafter allow the filter 74 to assume a voltage dictated by the duty cycle of the on-off states of the field effect transistor 12.

The output of the filter 74 decreases, when the transistor 92 becomes nonconductive, to a voltage value dictated by the duty cycle of the on-off states of the field effect transistor 12 while the armature is moving toward the stop position and then suddenly increases when the duty cycle suddenly decreases as the armature motion is stopped and the counter EMF generated by the moving armature terminates. The point in time at which the duty cycle changes direction and accordingly the voltage output of the filter 74 attains a minimum value and begins to increase is the time at which the armature has reached its stop position and fuel injection is initiated. This characteristic of the output of the filter 74 is detected and a signal provided to indicate the initiation of fuel injection.

A minimum voltage detector 116 and a timing flip flop 119 cooperate to sense the time at which the filter output reaches a minimum and begins to increase. This minimum voltage detector includes a comparator switch 118 which receives the voltage output of the filter 74 at its positive input and which receives the voltage charge of a capacitor 120 at its negative input. A pull-up resistor 122 is coupled between the regulated 8 volt source and the output of the comparator switch 118.

The capacitor 120 is initially charged from the 8 volt source through a PNP transistor 124, a resistor 126 and a diode 128. The conduction of the transistor 124 is controlled as will be described so that the charge path is terminated at a predetermined duty cycle of the transistor 12 operation that is always attained in a normally operating injector as its armature accelerates toward the stop position.

When the filter 74 output is greater than the charge on the capacitor 120, the output of the comparator switch 118 is high and the capacitor 120 is charged (assuming the transistor 124 is conductive). When the filter 74 output is less than the charge on the capacitor 120, the output of the comparator switch 118 is low and the capacitor 120 discharges through a diode 130 and a resistor 132. The comparator switch 118 therefore oscillates causing the voltage charge on the capacitor 120 to follow the voltage output of the filter 74. As the output of the filter 74 decreases while the armature of the injector accelerates toward its stop position, the voltage of the capacitor 120 is periodically discharged to maintain its charge substantially equal to the output of the filter 74.

While the transistor 124 is on, the charge of the capacitor will follow the output of the filter 74 when increasing or decreasing. While the transistor 124 is off, the charge of the capacitor will follow the output of the filter 74 only while the output of the filter 74 is decreasing in response to an increasing duty cycle of the on-off states of the transistor 12 since there is no charge path for the capacitor 120. As previously indicated and as will be described, the transistor 124 is biased off when the output of the filter decreases to a predetermined value representing a duty cycle of the transistor 12 operation that is always attained for a normally operating fuel injector as the armature accelerates toward the stop. Thereafter, as the duty cycle continues to increase thereby decreasing the output of the filter 74, the comparator switch 118 continues to oscillate because of the greater discharge rate of the capacitor 120 when the output of the comparator switch 118 is low. However, when the armature strikes the stop and the counter EMF generated by its movement through the coil 10 terminates, the duty cycle of the on/off states of the transistor 12 suddenly decreases resulting in an increase in the output voltage of the filter 74. The output of the comparator switch 118 switches to a high level and remains at this level since the capacitor 120 is no longer charged through the transistor 124.

The non-oscillating condition of the comparator switch 118 that results when the armature of the fuel injector reaches the stop position is sensed by the timing flip flop 119. The timing flip flop 119 begins timing at each positive transition of the output of the comparator switch 118 as it oscillates. If the output of the comparator switch 118 remains high for a predetermined time period, the flip flop 119 $\overline{Q}$ output shifts from a low to high level to clock a D-flip flop 136. The period timed by the timing flip flop 119 is established by a resistor 138 and a capacitor 140 whose values are selected such that the $\overline{Q}$ output of the timing flip flop 119 is maintained at its low level while the comparator switch 118 oscillates as the capacitor 120 is caused to track the output of the filter 74.

The flip flop 136 is initially reset when the injector command pulse is applied to the comparator switch 70 by the pulse generated by the differentiating capacitor 102. The $\overline{Q}$ output of the flip flop 136 is thereafter shifted from high to low by the timing flip flop 119 when the armature of the fuel injector hits the stop position as previously described. This transition of the $\overline{Q}$ ouput of the flip flop 136 comprised the indication of the start of fuel injection.

As previously indicated, the transistor 124 is biased off when the output of the filter 74 represents a predetermined on-off duty cycle of the transistor 12 that is attained when controlling a normally operating fuel injector. The control of the transistor 124 is provided by a comparator switch 142 which receives the output voltage from the filter 74 representing the duty cycle of the on-off states of the transistor 12 at its negative input.

The positive input of the switch 142 is initially set to ground potential when the injection command signal is first applied to the comparator switch 18 by means of a transistor 143 whose base is coupled to the Q output of the flip flop 90 through a resistor 144. The high voltage output of the Q output of the flip flop 90 when the injection command signal is first applied biases the transistor 143 on to ground the positive input of the comparator switch 142. Thereafter, when the flip flop 90 is clocked as the coil 10 current first obtains the regulated level, the Q output of the flip flop 90 is shifted to ground potential to bias the transistor 143 off. The voltage at the positive input of the switch 142 is then established by resistors 146 and 148 series coupled between the 12 volt source and ground. This voltage represents the aforementioned duty cycle that will occur in the case of a normally operating injector while its armature is accelerated to its stop position. When the duty cycle attains that level, the output of the filter 74 becomes less than the reference voltage at the positive input of the comparator switch 142 whose output shifts to a positive voltage to bias the transistor 124 off via the transistor biasing circuit including the resistors 150 and 152. At the same time a transistor 154 is biased on to provide a feedback through a resistor 156 to latch the comparator switch 142 in its high output state.

If the injector should be faulty such that the duty cycle as measured by the filter 74 does not attain the reference level applied to the positive input of the amplifier 142, its output remains at a low voltage level to maintain the transistor 124 on. Under this condition, the output of the comparator switch 118 continues to oscillate thereby inhibiting the timer flip flop 119 from timing out.

The foregoing description of a preferred embodiment for the purpose of illustrating the invention is not to be considered as limiting or restricting the invention since many modifications may be made by the skill in the art without departing from the scope of the invention.

The embodiments of the invention in which an exclusive property or privilege is claimed are defined as follows:

1. A circuit for controlling and indicating the operation of an electromagnetic fuel injector having a coil and an armature moved upon energization of the coil from a deenergized position to a stop position for controlling fuel injection, the circuit comprising in combination:

a voltage source, a switching element series coupled with the coil across the voltage source, the switching element having a conductive state wherein the coil is charged by the voltage source and having a nonconductive state;

a high voltage breakdown device for providing a discharge path for the coil when the switching element is in its nonconductive state;

means responsive to an injection command signal and the value of the coil current for setting the switching element in its conductive state to charge the coil when the coil current is less than a first value and setting the switching element in its nonconductive state to discharge the coil when the coil current is greater than a second value greater than the first value, the time required for the coil current to first reach the second value in response to an injection command signal being less than the time for the armature to move from its deenergized position to its stop position;

means for monitoring the duty cycle of the conductive and nonconductive states of the switching element, the duty cycle varying in one direction while the core accelerates from its de-energized position to its energized position and in the opposite direction after the core reaches the stop position; and means for generating a signal that indicates operation of the fuel injector at the time at which the duty cycle variation changes its direction.

2. A circuit for controlling and indicating the operation of an electromagnetic fuel injector having a coil and an armature moved upon energization of the coil from a deenergized position to a stop position for controlling fuel injection, the circuit comprising in combination:

a voltage source;

a transistor series coupled with the coil across the voltage source, the transistor having an on state wherein the coil is charged by the voltage source and having an off state;

a Zener diode coupled in parallel with the transistor for providing a discharge path for the coil when the transistor is in its off state;

a current sensing resistor coupled in series with the coil, the voltage across the resistor being a measure of the coil current;

means responsive to an injection command signal and the voltage across the current sensing resistor for biasing the transistor to its on state to charge the coil when the voltage across the current sensing resistor represents a coil current less than a first value and biasing the transistor to its off state to discharge the coil when the voltage across the current sensing resistor represents a coil current greater than a second value that is greater than the first value, the time required for the coil current to first reach the second value in response to an injection command signal being less than the time for the armature to move from it deenergized position to its stop position;

means for monitoring the on and off states of the transistor, the on state varying relative to the off state in one direction while the core accelerates from its deenergized position to its energized position and in the opposite direction after the core reaches the stop position; and means for generating a signal that indicates operation of the fuel injector at the time at which the variation of the on state relative to the off state changes its direction.

* * * * *